US005163295A

United States Patent [19]

Bradshaw

[11] Patent Number: 5,163,295

[45] Date of Patent: Nov. 17, 1992

[54] CONTROLLING EXHAUST GAS RECIRCULATION IN A PRESSURE BOOSTED INTERNAL COMBUSTION ENGINE

[75] Inventor: Cyril E. Bradshaw, Wheaton, Ill.

[73] Assignee: Eaton Corporation, Cleveland, Ohio

[21] Appl. No.: 756,739

[22] Filed: Sep. 9, 1991

[51] Int. Cl.[5] ..... F02M 25/07

[52] U.S. Cl. ..... 60/605.2; 123/568

[58] Field of Search ..... 123/568, 569; 60/605.2

[56] References Cited

U.S. PATENT DOCUMENTS

| | | | |
|---|---|---|---|
| 1,843,646 | 2/1932 | Moore | 123/568 |
| 3,880,129 | 4/1975 | Hollis, Jr. | 123/568 |
| 3,982,515 | 9/1976 | Bradshaw | 123/568 |
| 4,116,182 | 9/1978 | Bradshaw | 123/568 |
| 4,142,494 | 3/1979 | Negri et al. | 123/568 |
| 4,205,644 | 6/1980 | Treadwell et al. | 123/568 |
| 4,215,550 | 8/1980 | Dinger et al. | 60/605.2 |
| 4,222,356 | 9/1980 | Ueda et al. | 123/568 |
| 4,249,382 | 2/1981 | Evans et al. | 60/605.2 |
| 4,350,013 | 9/1982 | Yoshiba | 60/605.2 |
| 4,466,415 | 8/1984 | Piesche | 123/569 |
| 4,484,445 | 11/1984 | Gillbrand | 60/605.2 |

FOREIGN PATENT DOCUMENTS

| | | | |
|---|---|---|---|
| 2409774 | 9/1975 | Fed. Rep. of Germany | 123/569 |
| 0084841 | 6/1980 | Japan | 60/605.2 |

*Primary Examiner*—Willis R. Wolfe

*Attorney, Agent, or Firm*—R. A. Johnston

[57] ABSTRACT

A controller and method for controlling EGR in a pressure boosted engine. A valve seat is provided in the EGR passage and a hollow actuator rod is moved by a pressure-responsive diaphragm to control flow. The diaphragm senses boost inlet pressure in a chamber supplied through a port in the rod which extends through the boost air inlet passage. In another embodiment a restrictor valve is provided in the exhaust pipe downstream of the EGR passage. The valve is closed at idle to divert exhaust to the EGR passage. As boost pressure increases, a separate pressure tap supplies a second pressure-responsive diaphragm to open the restrictor valve.

10 Claims, 3 Drawing Sheets

CONTROLLING EXHAUST GAS RECIRCULATION IN A PRESSURE BOOSTED INTERNAL COMBUSTION ENGINE

BACKGROUND OF THE INVENTION

The present invention relates to methods and apparatus for controlling the recirculation of exhaust gas into the air inlet of a pressure boosted internal combustion engine. The invention relates particularly to control devices for exhaust gas recirculation (EGR) in pressure boosted compression ignition or diesel engines.

EGR has been found particularly desirable in eliminating "knock" in a diesel engine at cold idle and at light load conditions, to minimize the formation of oxides of nitrogen (NOx) in the exhaust in order to meet the governmental requirements for exhaust emissions in such engines, particularly in road vehicle applications of diesel engines. Known techniques for providing EGR in vehicular diesel engines have included providing a crossover passage between the engine exhaust pipe and the boosted air inlet, and providing a control valve operative in response to changes in pressure in the engine exhaust pipe, or by mechanical connection to the fuel injector control linkage or by a generated vacuum control signal.

However, where it is desired to provide maximum EGR at engine idle and diminish the amount of EGR as speed and load increase, it has been found cumbersome and difficult to provide adequate control of the EGR valve utilizing exhaust pipe pressure as the source of control signal generation. Alternatively, it has been suggested to provide an auxiliary vacuum pump to generate a control signal suitable for controlling EGR based upon a vacuum proportional to engine speed. However, this has proven to be costly and difficult to install in view of the additional hardware and plumbing for the vacuum pump in high volume mass production of road vehicles.

Thus, it has been desired to provide a way or means of controlling EGR in a pressure boosted engine in such a manner as to provide adequate EGR at engine idle and to control the EGR in accordance with the engine load conditions in a simple economical device which may be readily installed on mass produced engines for vehicular use.

SUMMARY OF THE INVENTION

The present invention provides a method and apparatus for controlling EGR in a boosted internal combustion engine and particularly a compression ignition engine, wherein a pressure-responsive diaphragm senses changes in pressure in a chamber connected to communicate with the boost air inlet pressure. The pressure-responsive diaphragm is connected to an actuator rod which moves a movable valve member for controlling flow in an EGR passage in response to changes in boost air inlet pressure. The actuator rod is hollow and ported through the sidewall thereof to communicate the boost air inlet pressure through the rod to the pressure sensing chamber. Additionally, a restrictor valve may be provided in the exhaust pipe downstream of the EGR passage to provide a restrictor valve normally closed at idle, but which is opened in response to increased boost air inlet pressure by a pressure-responsive actuator. The restrictor valve ensures sufficient divergence of exhaust gas at idle to maintain adequate EGR flow in the EGR passage.

DETAILED DESCRIPTION

Figure 1:
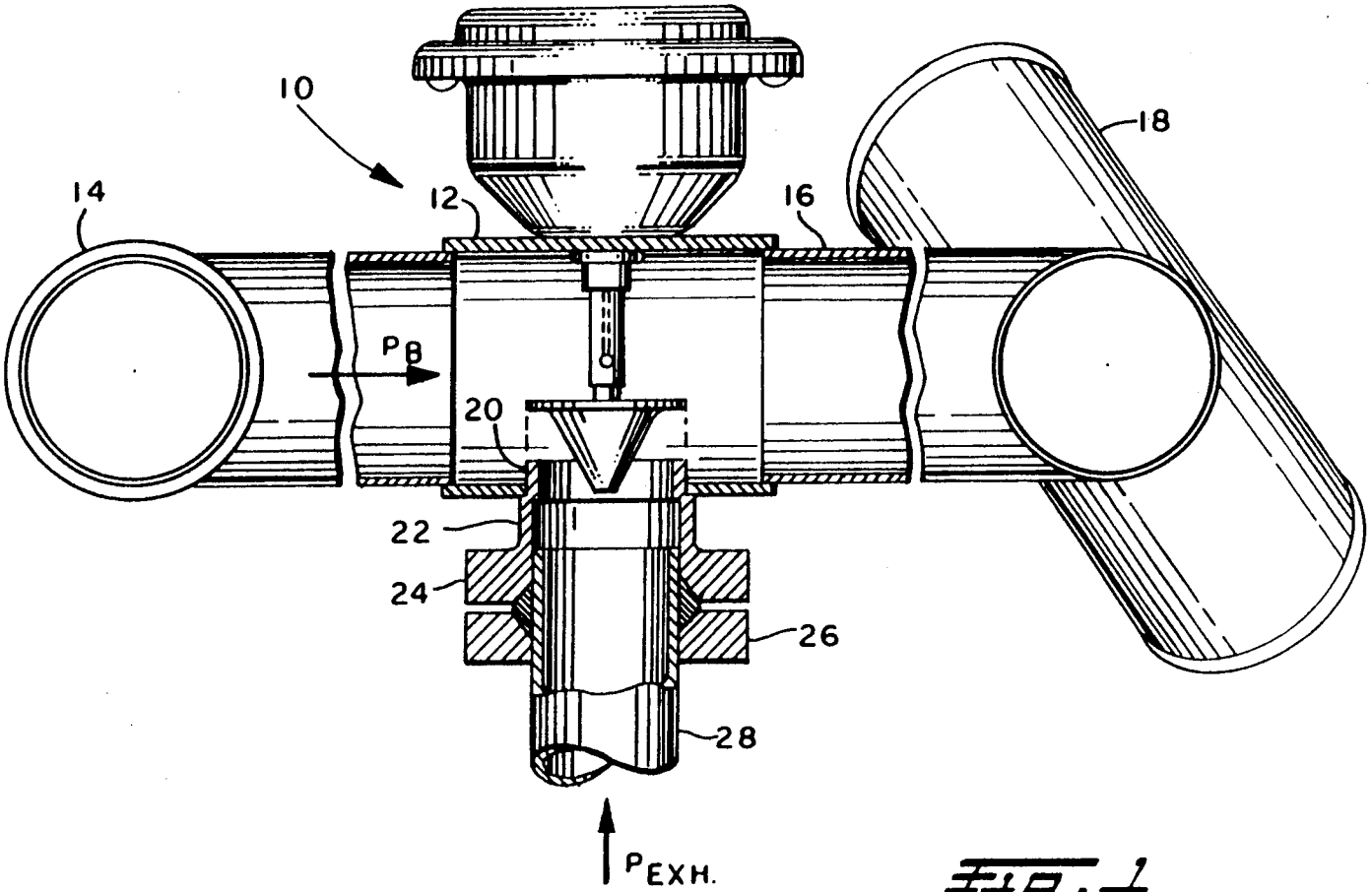
FIG. 1 is an installation view of the control apparatus of the present invention installed on the inlet of a pressure boosted internal combustion engine.

Referring to FIG. 1, the control apparatus of the present invention is indicated generally at 10 and includes a tube or conduit 12 connected at one end thereof to receive boost air at a pressure $P_B$ from a source of air in conduit 14. Conduit 14 is connected to receive boost air from any convenient source such as an exhaust-driven turbo charger or shaft-driven compressor, such as a Rootes type blower. Tube 12 is also connected at its opposite end to an engine air inlet tube 16, which is connected to the intake manifold 18 of an internal combustion engine; and, in particular, the invention has application where tube 16 is connected to the inlet manifold of a compression ignition or diesel engine. Tube 12 has an aperture 20 provided therein, which has received therein a tube 22 which has a flange 24 provided thereon for attachment to a similar flange 26 provided on an EGR tube 28, which is connected to the engine exhaust pipe for receiving therein exhaust gasses at a pressure $P_{EXH}$.

Figure 2:
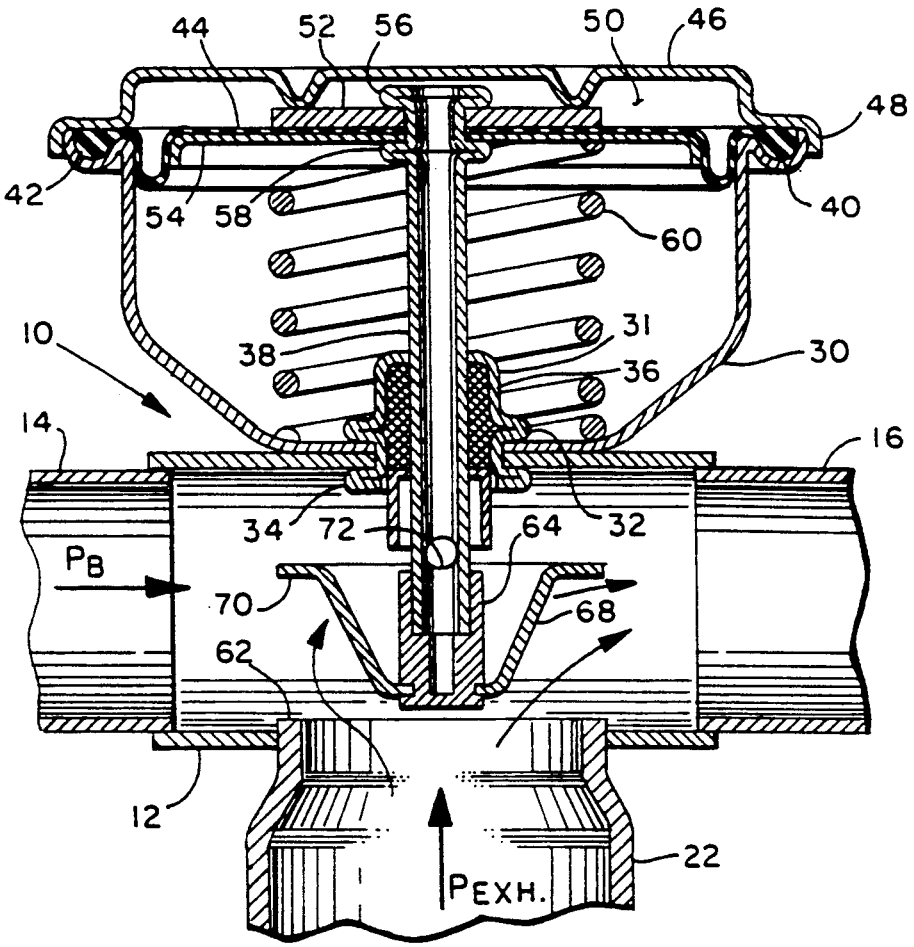
FIG. 2 is an enlarged cross-sectional view of the control apparatus of the present invention; and, FIG. 3 is a view similar to FIG. 1, illustrating an alternate arrangement of the present invention.

Referring to FIGS. 1 and 2, the apparatus 10 includes a housing shell attached to the tube 12 by a flanged or convoluted bushing 30, which serves to attach the shell to collar 12 by spaced convolutions 32,34. The bushing contains a suitable temperature-resistant packing material 36. An elongated actuator member 38 which, in the presently preferred practice, comprises a hollow tube slidably received in material 36.

Shell 30 has a cupped flange or rim 40 provided around the upper periphery thereof and into which is received a beaded rim 42 of an elastomeric diaphragm 44. Rim 42 is sealed in the flange 40 by cover 46 received thereon and sealed about the periphery of flange 40 by any suitable mechanical expedient as, for example, rolling or crimping the periphery thereof, as indicated by reference numeral 48. The cover 46 thus forms a sealed fluid pressure chamber indicated by reference numeral 50 in FIG. 2.

The upper surface of diaphragm 44 has a backing washer 52 provided centrally thereon; and, a lower backing plate 54 is provided centrally on the undersurface of the diaphragm 44. The diaphragm and backing plates 52,54 are sandwiched together and secured in fluid pressure sealing arrangement by convolutions 56,58 formed on the upper end of the actuator rod 38, which passes through central apertures in the backing plates and diaphragm.

The hollow portion of the actuator rod 32 communicates with the pressure chamber 50. A compression spring 60 received in the shell 30 has its upper end registered against the lower surface of backing plate 54 and its lower end registering against the lower end of shell 30 so as to bias the diaphragm in an upward direction.

Tube 22 has a valve seat 62 provided on the upper end thereof. Actuator rod 38 has a tubular cap 64 provided on the lower end thereof; and, cap 64 has attached thereto a conically tapered valve member 68, which has a radially outwardly extending flange 70 provided about the periphery thereof. The undersurface of flange 70 is configured to close against valve seat 62.

The hollow actuator rod 38 has the cross port 72 provided therein disposed intermediate the ends thereof and above the valve seating flange 70 so as to communicate the pressure $P_B$ through the hollow interior of rod 38, and in an upward direction to pressure chamber 50.

In operation, as the boost pressure $P_B$ rises to a predetermined level such as, for example, two inches of mercury pressure (2" Hg), the pressure in chamber 50, acting on the area of diaphragm 44 overcomes the bias of spring 60 and starts to move the valve member 68 in a downward direction. When the pressure $P_B$ reaches a second predetermined but higher level, the diaphragm moves the rod 38 downwardly sufficient to cause flange 70 to contact valve seat 62 and block off further EGR flow to tube 16. In the present practice of the invention, for a valve seat having a diameter of 1.30 inches (33.0 mm), the diaphragm and spring rate are chosen such that the flange 70 contacts the valve seat 62 when the boost pressure $P_B$ reaches the value of five inches of mercury (127 mm Hg).

Figure 3:
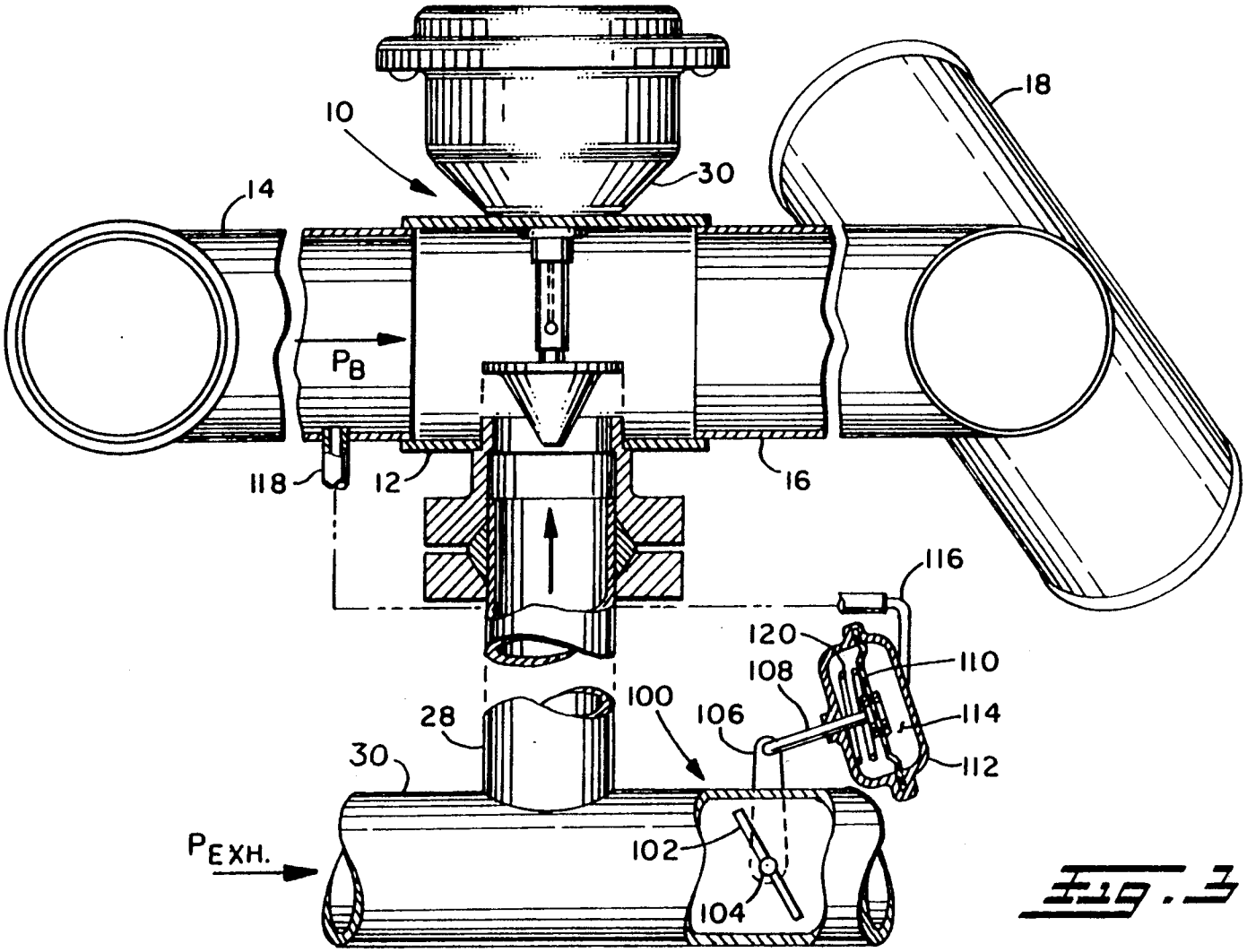

Referring to FIG. 3, an alternate arrangement of the invention is illustrated wherein EGR tube 30 is connected to the engine exhaust pipe 30 and a restrictor valve mechanism indicated generally at 100 is disposed in the exhaust pipe downstream of the connection to EGR tube 28. Restrictor valve assembly 100 comprises a butterfly 102 disposed interiorly of the tube 28 and attached to a shaft 104 journalled for rotation in the walls of the tube 28 by any suitable bearing arrangement (not shown). Shaft 104 has attached thereto a crank arm 106 which is capable of transmitting torque to shaft 104 for rotating valve member 102. Crank 106 is pivotally connected to an actuator rod 108, which has the opposite end thereof attached to a pressure-responsive diaphragm 110 disposed in the housing or shell 112 forming therein a pressure chamber 114. The shell 112 is connected via conduit 116 to a pressure tap 118 in pressure inlet tube 114 so as to communicate the pressure $P_B$ to chamber 14. A spring 120 is disposed within shell 112 to bias diaphragm 110 in a direction to cause the actuator rod 108 to close valve 102.

The arrangement of FIG. 3 provides that at idle or low boost inlet pressure $P_B$, restrictor valve 102 is in the closed position, diverting the exhaust to EGR passage 28; and, as the boost pressure $P_B$ rises above two inches of mercury (4.2 mm Hg), the diaphragm begins to move to open valve 102; and, when the boost pressure $P_B$ reaches five inches of mercury (10.6 mm Hg), the valve is in the fully opened position.

The present invention thus provides a unique and novel yet simply constructed pressure-responsive control valve assembly for insertion in the inlet of a pressure boosted internal combustion engine to control flow in the EGR passage. In one embodiment, the invention valve assembly is responsive to boost inlet pressure to progressively close the EGR valve as boost pressure increases. In another embodiment a restrictor valve is installed downstream in the exhaust pipe of the connection to the EGR crossover tube, so that at low boost pressure or idle, the exhaust is diverted to the EGR valve passage and as boost pressure increases, the diverter valve is progressively opened to increase flow in the exhaust pipe. The present invention thus provides a unique and novel method and apparatus for controlling EGR in a pressure boosted internal combustion engine, and has particular application in boosted compression ignition or diesel engines.

Although the present invention has been hereinabove been described with respect to the illustrated embodiments, it will be understood that the invention is capable of modification and variation, and is limited only by the spirit and scope of the following claims.

I claim:

1. A controller for exhaust gas recirculation (EGR) in a pressure boosted internal combustion engine of the type having an EGR passage between the engine exhaust and the boost air inlet, said controller comprising:

(a) housing means defining an EGR valving chamber having an inlet adapted for connection to said EGR passage and outlet adapted for connection to the boost air inlet;

(b) means defining a valve seat in said valving chamber;

(c) a valve member disposed for movement with respect to said valve seat for controlling flow between said inlet and said outlet;

(d) pressure-responsive means defining, in cooperation with said housing means, a pressure chamber; and, (e) an actuator means interconnecting said valve member and said pressureresponsive means for effecting movement of said valve member in response to pressure changes in said chamber, said actuator means defining a passage communicating through a passage formed in said pressure-responsive means the pressure of said boost air inlet with said pressure chamber, wherein, upon an increase in said boost pressure above a predetermined level, said pressureresponsive means is operative to effect movement of said valve member against said valve seat to block EGR flow to said boost air inlet.

2. The controller defined in claim 1, wherein said actuator means comprises a hollow rod extending externally of said valving chamber; and, said passage includes an aperture in the wall of said hollow rod disposed between said valve member and said pressure-responsive means.

3. The controller defined in claim 1, wherein said valve member has a conically tapered configuration.

4. The controller defined in claim 1, wherein said pressure-responsive means comprises a flexible diaphragm.

5. The controller defined in claim 1, wherein said actuator means comprises a hollow rod extending externally of said valving chamber; and, said means defining said passage includes a port through the wall of said hollow rod.

6. A method of controlling flow of exhaust gas in an EGR passage of an inlet boosted injector controlled internal combustion engine comprising the steps of:

(a) providing a movable EGR valve member in said EGR passage;

(b) sensing the pressure in said boosted inlet and moving said EGR valve in response to changes in said sensed pressure;

(c) providing a movable restrictor valve member in the engine exhaust downstream of said EGR passage; and (d) moving said restrictor valve in response to changes in said sensed boost pressure.

7. The method defined in claim 6, wherein said step of moving said EGR valve member includes the step of closing said valve member against a valve seat when said boosted inlet pressure reaches a predetermined level.

8. An exhaust gas recirculation (EGR) controller for an air inlet pressure boosted internal combustion engine having an EGR passage connecting the engine exhaust with said air inlet, said controller comprising:

(a) housing structure defining a pressure chamber with a pressure-responsive means forming a portion of the wall of said chamber;

(b) an elongated actuator member having one end thereof operatively connected to said pressure-responsive means;

(c) a valve member adapted for contacting a valve seat in said EGR passage and connected to the end of said actuator rod opposite said one end;

(d) means defining a boost pressure passage in said actuator rod, with a boost air passage port intermediate the ends of said rod, said passage communicating with air inlet boost pressure through said pressureresponsive means with said pressure chamber; and (e) said housing structure including means operative for guiding movement of said actuator rod for moving said valve in response to changes in pressure in said pressure chamber;

9. The controller defined in claim 8, wherein said rod member is slidably moved in the direction of elongation and said guide means comprises a fluid pressure sealed bushing.

10. The controller defined in claim 8, wherein said valve member has a generally conically tapered configuration.

* * * * *